US005911332A

United States Patent [19]

Wickland et al.

[11] Patent Number: 5,911,332

[45] Date of Patent: Jun. 15, 1999

[54] HEPA FILTERED STORAGE CANISTERS

[75] Inventors: Terry J. Wickland, Golden; Carl Stephens, Arvapa, both of Colo.

[73] Assignee: Nuclear Filter Technology, Inc., Golden, Colo.

[21] Appl. No.: 08/988,070

[22] Filed: Dec. 10, 1997

Related U.S. Application Data

[63] Continuation-in-part of application No. 08/707,493, Sep. 25, 1996, Pat. No. 5,727,707.

[51] Int. Cl.[6] ..... B65D 51/29

[52] U.S. Cl. ..... 220/288; 220/303; 220/371; 220/642

[58] Field of Search ..... 220/288, 303, 220/371, 642, 640, 643, 644

[56] References Cited

U.S. PATENT DOCUMENTS

| | | | |
|---|---|---|---|
| 971,450 | 9/1910 | Lake | 220/640 |
| 1,178,964 | 4/1916 | Stoddard | 220/642 |
| 2,714,469 | 8/1955 | Carlson | 220/640 |
| 3,101,857 | 8/1963 | Freedman | 220/642 |
| 3,977,560 | 8/1976 | Stumpf et al. | 220/371 |
| 4,136,796 | 1/1979 | Dubois et al. | 220/371 |
| 4,500,328 | 2/1985 | Brassell et al. . | |
| 4,624,380 | 11/1986 | Wernette | 220/642 |
| 4,696,409 | 9/1987 | Vizz | 220/303 |
| 4,756,852 | 7/1988 | Temus . | |
| 4,957,522 | 9/1990 | Brassell . | |
| 5,042,579 | 8/1991 | Crowson et al. . | |
| 5,111,955 | 5/1992 | Baker et al. | 220/303 |
| 5,193,709 | 3/1993 | Brassell . | |
| 5,353,949 | 10/1994 | Seibert et al. . | |
| 5,395,006 | 3/1995 | Verma | 220/371 |
| 5,649,639 | 7/1997 | Dolvet et al. | 220/371 |

*Primary Examiner*—Joseph M. Moy
*Attorney, Agent, or Firm*—Millen, White, Zelano & Branigan, P.C.

[57] ABSTRACT

Plutonium powders are stored in three embodiments of stainless steel canisters with stainless steel lids. The stainless steel canisters are extruded and have no interior welds. Each canister has a stainless steel lid with a vent having an integral HEPA filter. In order to secure the lids on the canister, collars with annular internal notches and external threads are disposed between the bodies of the canisters and the lids. The lids have internal threads so that the lids can be tightly screwed onto the collars. O-ring seals are disposed between the lids and collars.

22 Claims, 4 Drawing Sheets

HEPA FILTERED STORAGE CANISTERS

RELATED APPLICATIONS

This application is a continuation-in-part of U.S. patent application Ser. No. 08/707,493 field Sep. 25, 1996, now U.S. Pat. No. 5,727,707 now allowed and incorporated herein by reference.

FIELD OF THE INVENTION

The present invention relates to HEPA filtered storage canisters. More particularly, the present invention relates to HEPA filtered storage canisters, especially useful for storing radioactive materials, such as plutonium and uranium, in the form of oxides and salts, as well as in other forms.

BACKGROUND OF THE INVENTION

Plutonium is a man-made radioactive element which is used as an explosive ingredient in nuclear weapons and as a fuel for nuclear reactors. It has the important nuclear property of being readily fissionable with neutrons and is available in relatively large quantities. Caution must be exercised in handling plutonium to avoid unintentional formation of critical mass. Plutonium in liquid solutions is more apt to become critical than solid plutonium, so it is also very important to avoid the unintentional creation of a liquid solution. Since plutonium is considered to be highly carcinogenic, it is important that plutonium in any form be contained and not escape into the surrounding environment where it can be inhaled or otherwise ingested by humans or other living things. Frequently, plutonium oxides and salts are in the form of powders which require very special handling to ensure that particles do not become suspended in the air and that liquid does not come into contact with the powders. It is also very important that, if fluid occurs in or develops in the powders, that containers holding the powders are vented.

SUMMARY OF THE INVENTION

In view of the aforementioned considerations, it is a feature of the present invention to provide new and improved canisters for storage of hazardous materials such as radioactive materials.

In view of these features and other features, the present invention is directed to canisters for containing hazardous materials. The canisters comprise a seamless canister body having a mouth to which is welded a collar. The collar has an external helical thread and an internal shoulder which receives the mouth of the canister body. The canister body is closed by a lid having a plate portion and a depending rim portion, with the depending rim portion having an internal helical thread for threadably engaging the external thread of the collar to retain the lid on the canister body. An annular gasket is disposed in either the lid or the collar for sealing the mouth of the container and an HEPA filter assembly is integral with the lid.

In a more specific aspect, the canister is made of stainless steel and is useful for containing radioactive materials such as plutonium powders.

In still another more specific aspect, the canister cooperates with other similar canisters of different capacities and sizes to nest therewith.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
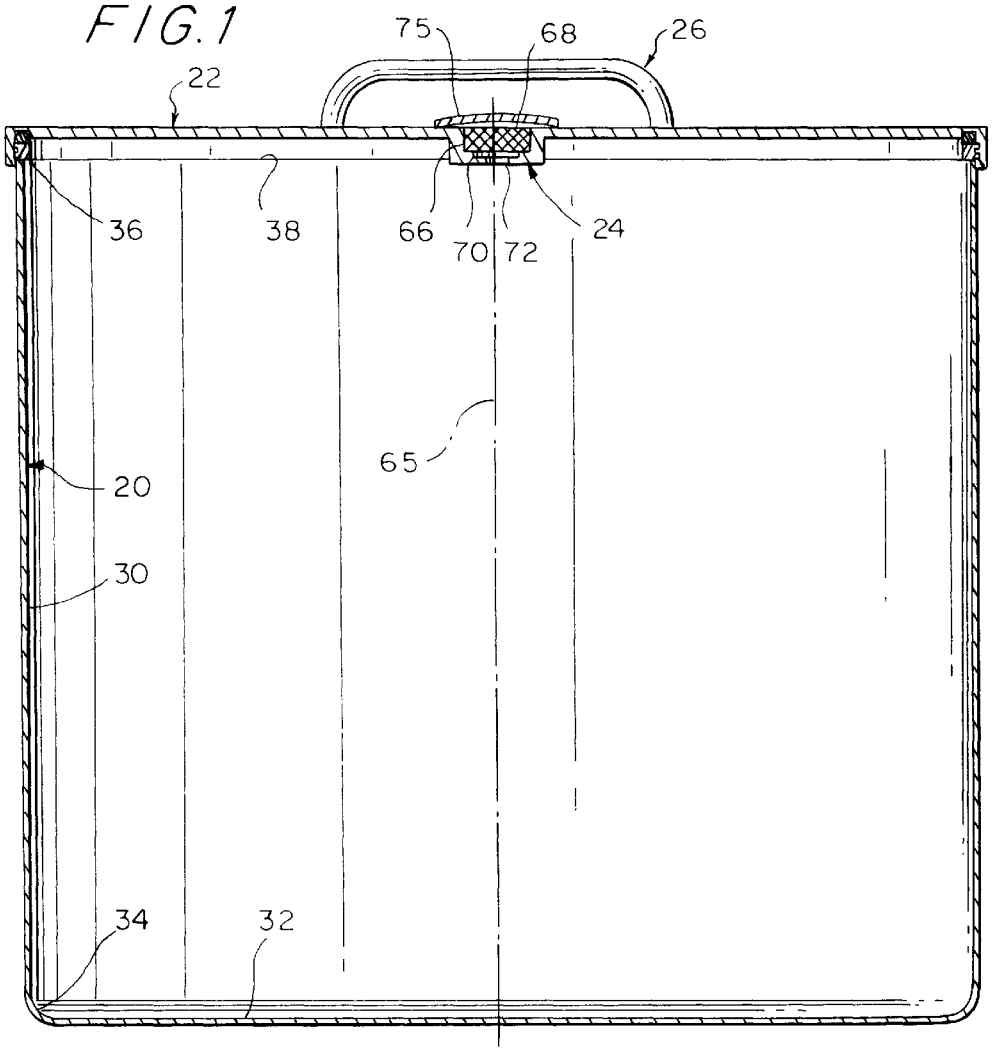
FIG. 1 is a side elevation of a first embodiment of a canister configured in accordance with the principles of the present invention.

Canisters illustrated in FIGS. 1–8 are of various sizes as is illustrated in FIG. 1 of U.S. patent application Ser. No. 08/707,493 filed Sep. 25, 1996 and incorporated herein by reference.

Figure 2:
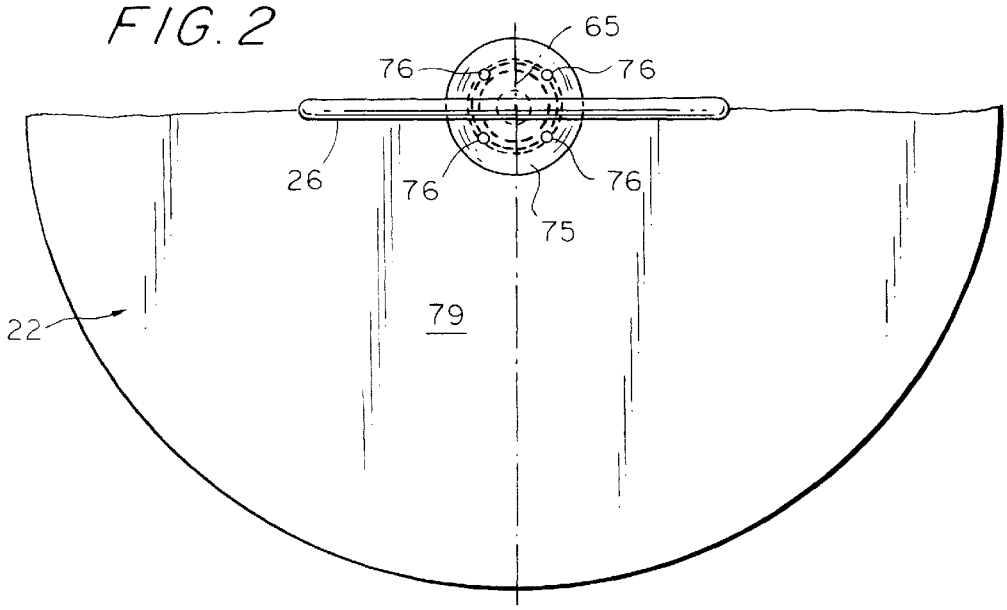
FIG. 2 is a top view of the canister of FIG. 1 with about one-half the top broken away.
Figure 3:
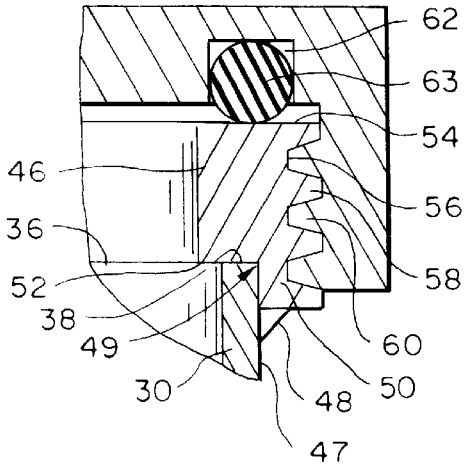
FIG. 3 is enlarged elevation of a portion of FIG. 1 taken on lines 3—3 of FIG. 1.

Referring now to the first embodiment of the invention as illustrated in FIGS. 1–3, there is shown a canister 10 especially useful for storage of plutonium powders in the form of plutonium oxides and salts. Generally, the canister 10 is opened only within a glove box (not shown) for filling or emptying. While storage of plutonium powders is of special significance, the canister 10 may be used for storing other materials, especially hazardous materials such as other nuclear waste materials. Canister 10 includes a canister body 20, a lid 22 and HEPA filter assembly 24 integral with the lid and handle 26 unitary with the lid. The canister body 20 is comprised of the side wall 30 which is unitary with a flat bottom 32 joined thereto by a radius comer 34. Canister body 20 has a wide mouth 36 which has the same dimensions as the canister wall 32. In other words, a top view of the mouth 36 appears essentially the same as a section through the wall 30 taken parallel to a top view of the mouth.

Accordingly, an upper edge 38 of the wall 30 is an annulus with thickness equal to the thickness of the wall 30.

The canister body 20 is extruded from 20 gauge 304 stainless steel. The interior surface of the side wall 30 is highly polished to a surface finish smoother than a #32 finish. Accordingly, even the finest powder grains of the powered plutonium salts or oxides stored in the interior space 40 of the canister will not adhere to the inside surface of the wall party of the canister body 20.

The canister body 20 has thereon an externally threaded steel collar 46 which is welded to the exterior surface 47 of the canister wall 30 by a weld 48 to form a seam 49. As is best seen in FIG. 3, the collar 46 has a lip portion 50 which abuts the exterior surface 47 of the wall 30 and annular bottom surface 52 which forms an annular shoulder against which the top edge 38 of the side wall 30 abuts. The bottom surface 52 and lip portion 50, cooperate to form a notch 53. The collar 46 further has a top surface 54 and an outer peripheral surface 56 which is defined by external threads 58. The external threads 58 provide for approximately four turns of the lid 22 which is threaded to the threads 58 by complimentary internally projecting threads 60 on the lid 22.

Lid 22 encloses the annular groove 62 which receives an 0-ring seal 63. Upon engaging the external threads 58 with the internal threads 60 of the lid 22 and rotating the lid 22 clockwise, the 0-ring seal 63 is compressed by the annular top surface 54 of the collar 46, thus pneumatically sealing the upper edge 38 of the canister body 20 to the lid 22.

The seam 49 formed by the abutment of the notch 52 of the collar 46 with the edge 38 of the mouth 36 and with the exterior surface 47 of the canister wall 30 is the only seam in the canister body 20. Weld 48 which closes the seam and fixes the collar 46 to the mouth 36 of the canister body is an internal weld which substantially lessens the possibility that the material within the interior 40 of the canister 10 corrode the annular weld 48. The chance that the seal 49 will be compromised is thus minimized since powders are discouraged from migration in any substantial quantity to the seam 49.

Beneath the handle 26 there is centrally disposed the vent 24 is centrally disposed on an axis 65. In the first embodiment of the invention, the vent 24 is formed by a unitarily formed cavity 66 having side walls 68 and bottom wall 70 with a vent 72 therein. In the lingual cavity 66 there is a carbon-carbon filter 76 which is anchored in place by a polymer adhesive, such as DOW HIGH TEMP RTV. A cap 77 with perforations 78 is spot welded at four locations to an upper surface 79 in the lid 22 in order to shield the carbon-carbon filter element from direct physical contact with objects which might damage the filter element. By positioning the vent 24 beneath the handle 26, the handle 26 further prevents direct physical contact of the vent 24 which might accidentally damage the vent and compromise the system provided by the canister 10 for containing the hazardous material therein.

Figure 5:
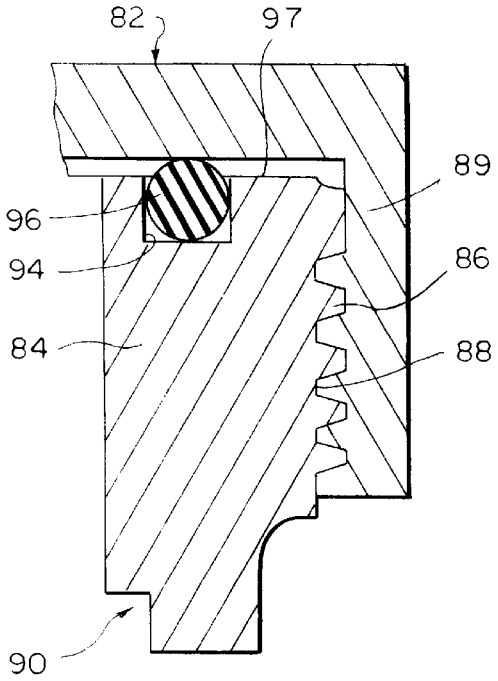
FIG. 5 is an enlarged view of a portion of the canister shown in FIG. 4 taken along lines 5—5 FIG. 4, with about one-half the canister broken away.
Figure 8:
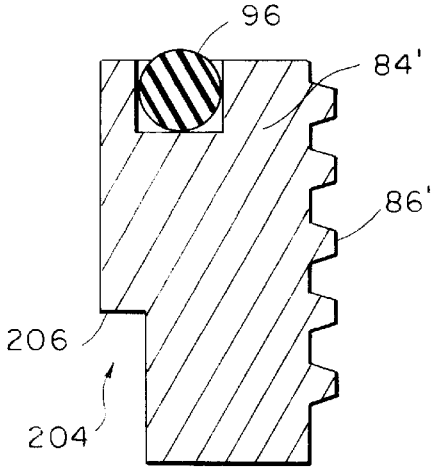
FIG. 8 is an enlarged elevation taken along lines 8—8 of FIG. 7.
Figure 4:
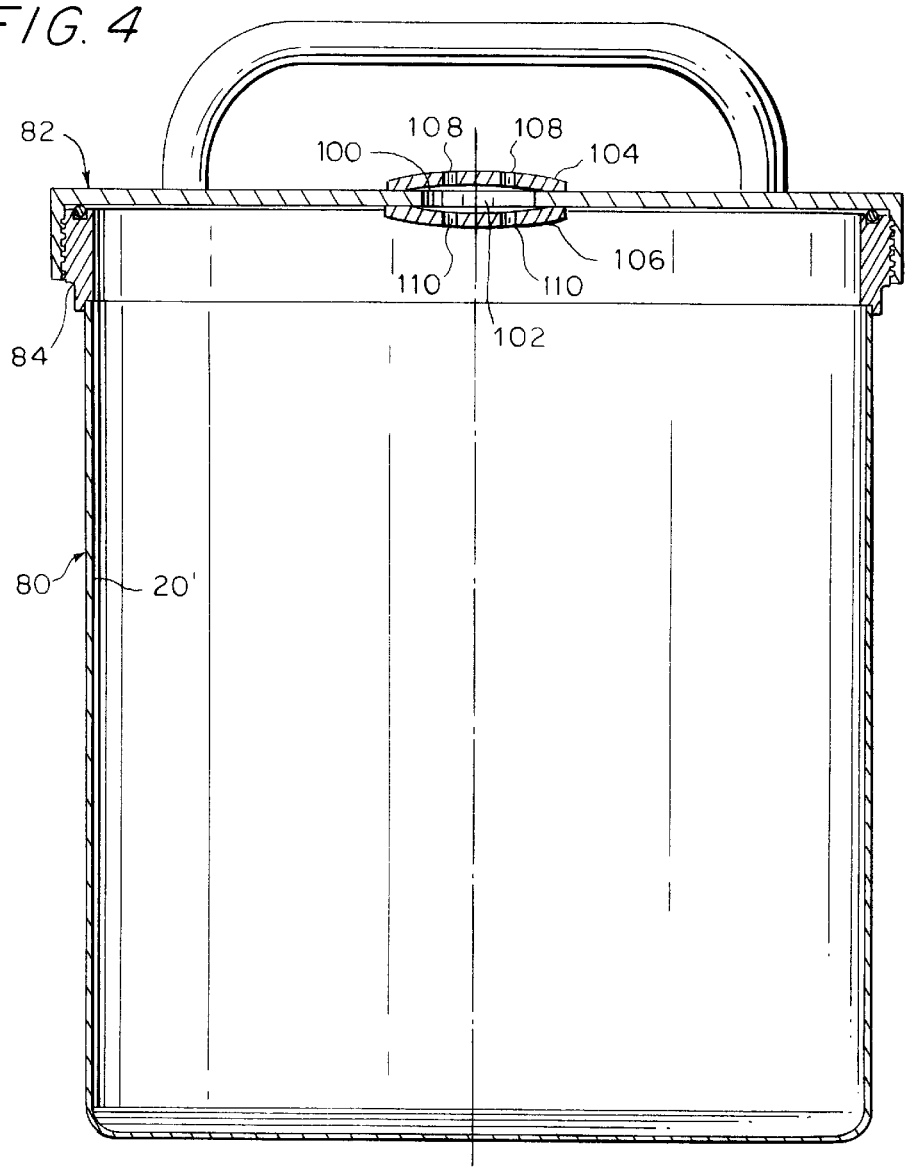
FIG. 4 is a side elevation of a second embodiment of a canister configured in accordance with the principles of the present invention.
Figure 6:
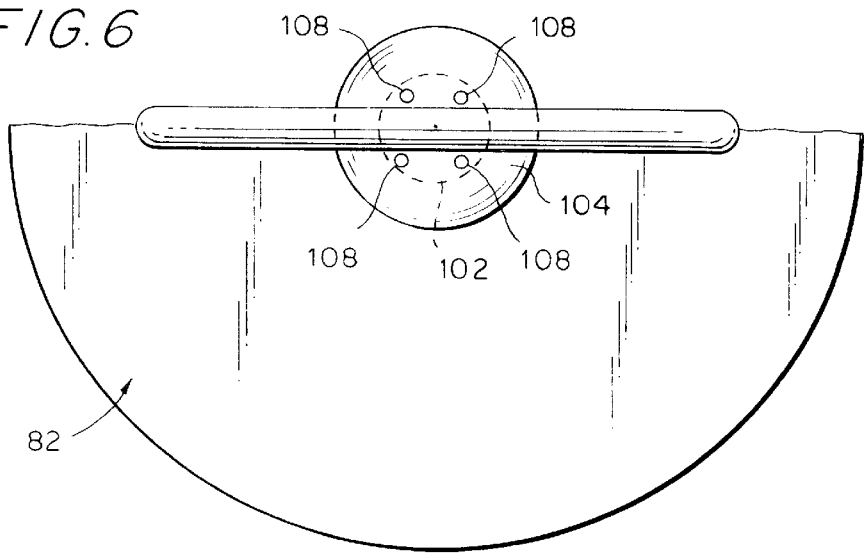
FIG. 6 is a top view of canister of FIG. 4.
Figure 7:
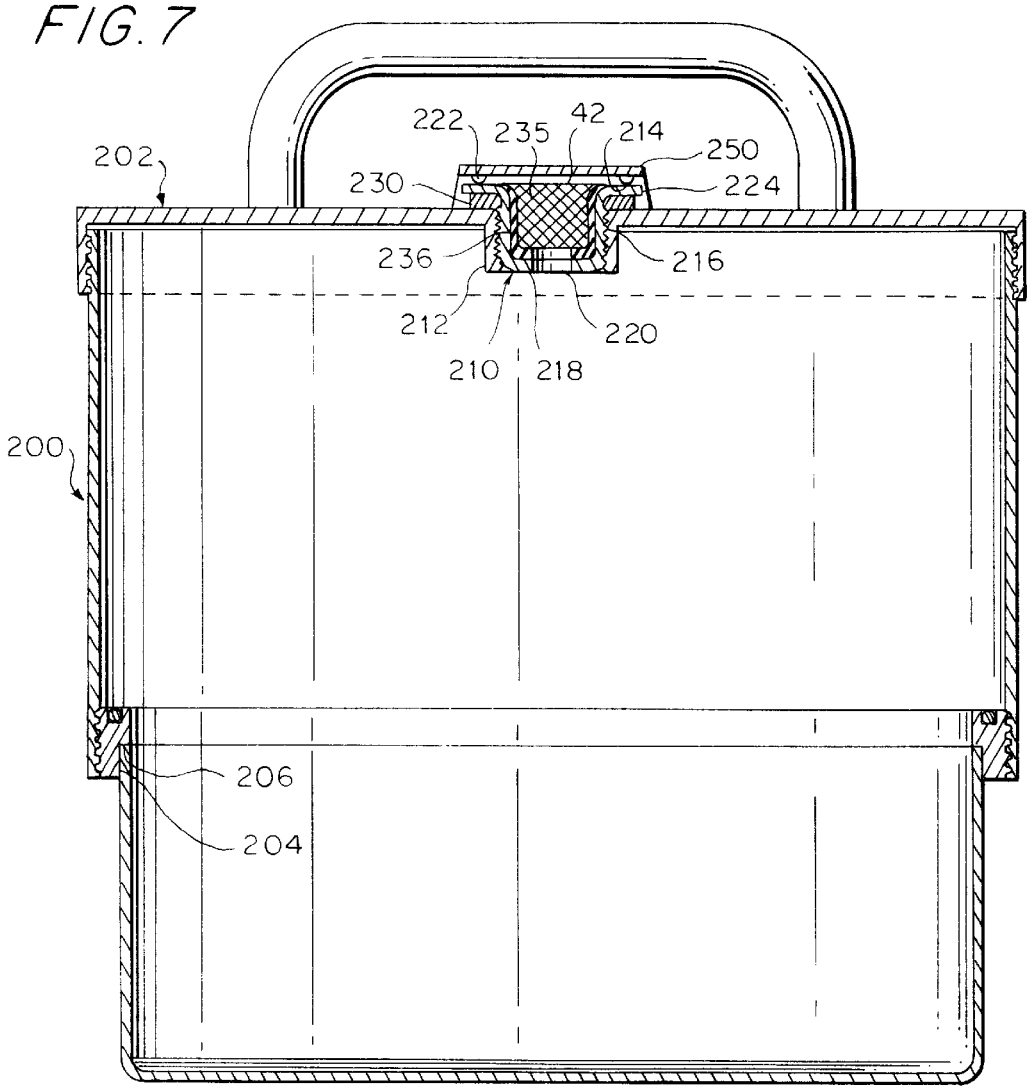
FIG. 7 is side elevation of a third embodiment of a canister configured in accordance with the principles of the present invention.
Figure 9:
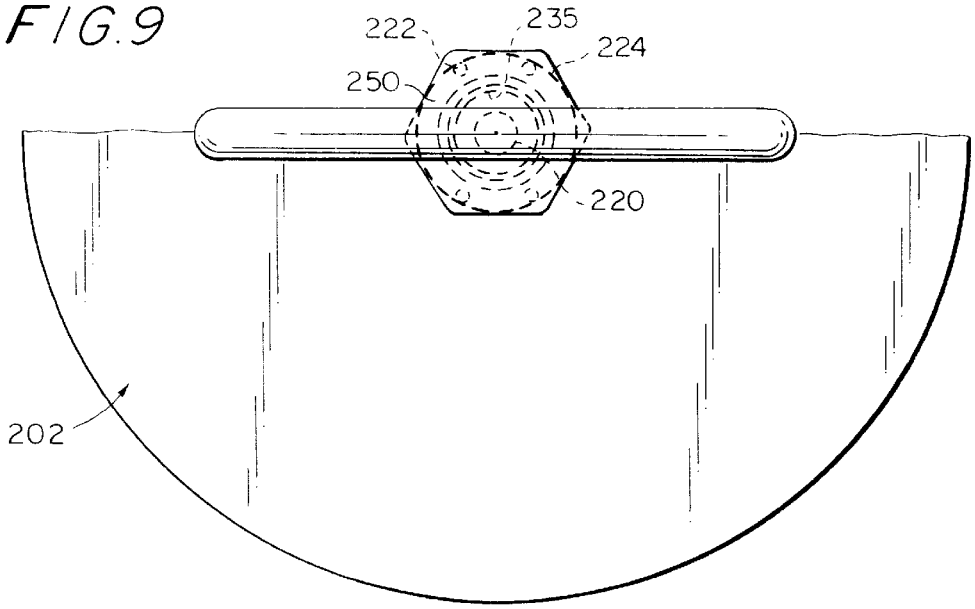
FIG. 9 is a top view of the canister of FIG. 7, with about one-half the canister broken away.

Referring now to FIGS. 4–6, there is shown a second embodiment of the invention wherein canister 80 is provided. The canister 80, has a canister body 20' which is substantially similar to the canister body 20 of the first embodiment but has a different lid. The second embodiment includes a lid 82 and collar 84 which are different, in that the collar 84 has a substantially greater axial length, as well as a longer external thread 86 than the collar 46 for threadably connecting with a longer internal thread 88 on a rim 89 of a lid 82. Collar 84 has a notch 90 therein which cooperates with the mouth 36' of the container body 20' in substantially the same way as the notch 53 of collar 46 cooperatives with the mouth 36, as a seen best in FIG. 3.

An annular groove 92 in upper surface 94 of collar 84 receives an 0-ring seal 86 which seals with the bottom surface 97 of the lid 82 as the lid is threaded onto the collar.

In this second embodiment, the lid 82 of the canister 80 includes a vent 100 formed by a circular recess 102 in the lid 82. The circular recess 102 has been followed by the upper plate 104 and a lower plate 106, which plates have perforations 108 and 110 therethrough which allow gas and vapor to vent from the canister 80. In the cylindrical recess 100 a filter media 112 of sintered stainless steel is disposed, which filter media is covered by a GORTEX® membrane 113. The sintered stainless steel filter media 112 traps particular matter while the GORTEX® membrane 113 prevents liquid from passing through the vent while allowing gas to escape from the canister 80.

As is apparent from the size of the handle 26' used with the canister 80, the canister 80 has a substantially smaller diameter than the canister 10 of FIGS. 1–3. In addition, the canister 80 has a height less than the canister 10.

Referring now to the third embodiment of the invention, there is shown a canister 200 in which the canister body 20" thereof has substantially the same structure as the container bodies 20 and 20' of the first and second embodiments. In the third embodiment of the canister, the collar 84' is substantially the same as the collar 84 of the second embodiment of the canister 80, with the collar sealing with and threading to a container lid 202 using an 0-ring 96', internal and external threads 86' and 88' in the same manner as the canister 20. An exception is that the collar 84' has a longer notch 204 than the notch 90 (FIG. 5) of the collar 84 used with the canister 80 (see FIG. 4). In addition, the notch 204 has a shoulder 206 which has a width substantially the same as the thickness of the container wall 30" of canister body 20".

The lid 202 of the canister 200 has a vent 210 thereto formed in a unitary, internally threaded collar 212. The collar 212 forms a housing which receives a filter assembly 214 which has a threaded exterior surface 216 and a bottom 218 which has an aperture 220 therethrough. The filter assembly 214 further has a flange 222 thereon which has a hex nut or otherwise nonround periphery. An annular gasket 230 is position beneath the flange 222 so that when the housing of 215 of the assembly 214 is threaded into collar 212, the gasket 230 is compressed against the top surface of the lid 202, thus sealing the filter assembly firmly within the internally threaded collar 212.

A carbon-carbon filter block 235 is held within the filter assembly 214 by a high temperature resistant adhesive 236. A barrier plate 240 is welded to the flange 222 in spaced relation thereto to provide a gap 242. The gap 242 is maintained by spaced apart projections 244 which allow gas and vapor to escape between the plate 242 and the flange 222. In the gap 242 there is fixed a GORTEX® barrier 250 which prevents liquid from entering the canister 200 but allows gas and vapor to exhaust therethrough to the atmosphere.

Preferably, the vent 210 is offset from the axis 260 of the canister 200 so that it is not beneath the handle 26". This allows for sufficient clearance so that the person gripping the handle 26"can comfortably wrap his or her fingers around the handle.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A canister for containing hazardous material, the canister comprising:

a seamless canister body of a first thickness, the canister body having a mouth defined by a circular edge of a selected thickness;

a collar having second thickness greater than the first thickness, the collar having an upper surface and a lower surface, the lower surface having an internally facing notch for receiving one circular edge defining the notch of the canister body, the collar further having an external helical thread formed therein;

a lid having a plate portion and a depending rim portion, the depending rim portion having internal threads for threadably engaging the external threads of the collar for retaining the lid on the canister body;

an annular gasket is disposed between the lid and upper surface of the collar for sealing the container adjacent to the circular edge thereof; and a filter assembly is integral with the lid to form a vent therethrough.

2. The canister of claim 1 wherein the filter assembly comprises a cavity in the lid having an opening therein communicating with the interior of the canister body, the filter assembly further comprising a block of filter material seated within the housing.

3. The canister of claim 2 further including a cap with perforations therein overlying the block of filter material and being affixed to the lid.

4. The canister of claim 3, wherein the filter further comprises a GORTEX® sheet between the cap and block of filter material.

5. The canister of claim 4, wherein the block of filter material is a carbon—carbon block or a block of sintered stainless steel.

6. The canister of claim 5, wherein the canister body is made of stainless steel and the canister lid is made of stainless steel.

7. The canister of claim 1, wherein the canister body and lid are made of stainless steel.

8. The canister of claim 7, wherein a handle is integral with the lid for carrying the canister.

9. The canister of claim 1 wherein the seal is provided in an annual groove in the lid.

10. The canister of claim 1 wherein the seal is disposed in an annual groove in the upper surface of the collar.

11. The canister of claim 1 wherein the filter assembly forming the vent is not aligned with the axis of the canister.

12. The canister of claim 1 wherein the filter assembly includes a filter element comprised of sintered stainless steel covered by a layer of GORTEX® and disposed in a circular aperture in the lid, the circular aperture being covered by perforated plates disposed on opposite sides of the circular aperture.

13. The canister of claim 1 wherein the filter assembly is removable from the lid.

14. The canister of claim 13 wherein the filter assembly includes an internally threaded aperture through housing containing a filter element, wherein the external housing is screwed into the threaded aperture so as to be removable therefrom.

15. The canister of claim 14 wherein the housing includes a cover plate attached thereto by spacers to provide a space between the filter element and the cover plate for venting therebetween.

16. The canister of claim 15 wherein the cover plate and space covered by a GORTEX® membrane having a periphery which is sealed to the lid.

17. A canister for storing hazardous material, such as powdered uranium oxides and salts, the canister comprising:

an extruded, seamless, stainless steel canister body of a first thickness, the canister body having a wide mouth defined by a circular edge of a selected thickness;

a stainless steel collar having a second thickness greater than the first thickness, the collar having an upper surface and a lower surface, the lower surface having an externally facing notch for receiving the circular edge defining the mouth of the canister body, the collar further having an internal helical thread formed thereon;

a stainless steel lid having a plate portion and a depending rim portion, the depending rim portion having internal threads for threadably engaging the external threads of the collar for retaining the lid on the canister body;

an annular gasket disposed between the lid and the upper surface of the collar for sealing with the mouth of the container adjacent the circular edge thereof; and an HEPA filter assembly integral with the lid.

18. The canister of claim 17 further including a cavity in the lid having an opening therein communicating with the interior of the canister body, the HEPA filter assembly comprising a block of filter material seated within the cavity.

19. The canister of claim 18 further including a cap with perforations therein overlying the block of filter material and being affixed to the lid.

20. The canister of claim 19, wherein the filter assembly further comprises a GORTEX® sheet disposed between the perforated cap and the block of filter material.

21. The canister of claim 20, wherein the block of filter material is a carbon—carbon block or a block of sintered stainless steel.

22. The canister of claim 17, wherein a handle is integral with the lid for carrying the canister.

* * * * *